US007213289B2

(12) United States Patent
Jaffe

(10) Patent No.: US 7,213,289 B2
(45) Date of Patent: May 8, 2007

(54) BATTERY POWERED GROUT BRUSH

(75) Inventor: Jonathan A. Jaffe, Voorhees, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 125 days.

(21) Appl. No.: 11/111,429

(22) Filed: Apr. 21, 2005

(65) Prior Publication Data

US 2006/0236474 A1 Oct. 26, 2006

(51) Int. Cl.
*A46B 13/02* (2006.01)

(52) U.S. Cl. ..... 15/28; 15/23

(58) Field of Classification Search ..... 15/23, 15/24, 28, 29

See application file for complete search history.

(56) References Cited

U.S. PATENT DOCUMENTS 922,225 A * 5/1909 Wegner ..... 15/344
1,571,773 A * 2/1926 Force ..... 15/28
2,301,849 A * 11/1942 Bialy ..... 15/29
3,407,431 A * 10/1968 Melnik ..... 15/344
4,299,004 A * 11/1981 Lancaster ..... 15/97.1
4,724,563 A * 2/1988 Fry et al. ..... 15/28
4,885,815 A * 12/1989 Smith ..... 15/28
5,636,400 A * 6/1997 Young ..... 15/23
2004/0255410 A1* 12/2004 Schonewille et al. ..... 15/29

FOREIGN PATENT DOCUMENTS

DE 29819459 U1 * 4/1999
DE 20300917 U1 * 6/2003

* cited by examiner

*Primary Examiner*—Mark Spisich
(74) *Attorney, Agent, or Firm*—Stuart M. Goldstein

(57) ABSTRACT

A manually operated, handled grout brush has an outer housing which encloses upper and lower contiguous spaces. Electric batteries in the upper space run an electrical motor, which powers gearing to rotate two sets of brushes, a grout brush head with rigid bristles for hard scrubbing and scouring dirty, mildewed, and stained rough grout surfaces, and a tile scrubbing brush head which may include one or two common scrub brushes for cleaning glossy, smooth tile surfaces.

8 Claims, 2 Drawing Sheets

BATTERY POWERED GROUT BRUSH

BACKGROUND OF THE INVENTION

Grout is commonly used between tiles, not only to connect and seal adjacent tiles, but also to enhance the overall appearance of tiled surfaces. Following initial installation of lined grout between tiled surfaces, the newly laid grout between the tiles is clean, unsoiled and presents a generally bright and fresh appearance. However, as time passes the tile surface is exposed to day-to-day activity which causes it to lose its initially clean and bright finish. It becomes darkened, dirty, mildewed, and stained. No matter how clean the actual tiles are which make up the tile surface, the adjacent grout which is dull, dirty, or stained grout will substantially detract from the overall appearance.

Cleaning soiled, mildewed, and stained grout, especially grout located between tile, has always been difficult. Although spray on or other liquid cleaners are advertised as grout cleaning agents, these, in and of themselves, are not truly effective. Hand scrubbing or scouring grout between tiles with a grout brush, perhaps in combination with these cleaning agents, is the only effective way of cleaning grout.

Manual grout brushes routinely have a single set of bristles and require rigorous back and forth hand motion against the soiled grout. This obviously becomes very strenuous for the user. It also results in the effectiveness of the cleaning operation to diminish quickly. Moreover, hand scrubbing requires that the user's hands be quite close to the grout and tiles. Over a prolonged period, the user, at some point, will scrape his or her fingers or knuckles on the grout or tile surface.

In addition, prior grout brushes have only one scrubbing surface which typically comprises hard, rigid bristles for cleaning ingrained dirt and stains in the rough, hardened grout material. Such brushes are not designed to be used on tile surfaces, on which dirt tends to be easier to remove. In fact, such hard bristle grout brushes should not be used to scrub and clean tile surfaces, which tend to be smooth, shiny, and as a result, more susceptible to being scratched or otherwise damaged by the action of hard bristles. As a result, after grout surfaces are cleaned with one brush, it is necessary that a second brush be used for the tile surface. Even the powered brushes which are used to a limited extent to clean grout, only have a single brush surface.

SUMMARY OF THE INVENTION

It is thus an object of the present invention to overcome the disadvantages and limitations of prior grout brushes.

It is an object of the present invention to provide a grout brush capable of cleaning both tile grout and surrounding tile surfaces with a single, manually operated, lightweight, portable handheld implement.

It is another object of the present invention to provide a grout brush which efficiently, effectively, and simply cleans grout between tile surfaces and also can be used to clean surrounding tiles with minimal effort.

It is a further object of the present invention to provide a grout brush which cleans tile grout and surrounding tile surfaces without undue threat of injury to the user.

It is still another object of the present invention to provide a grout brush with two brush cleaning surfaces on a single cleaning implement, a rotatable brush member for hard scrubbing and scouring rough grout and a second set of rotatable brushing elements for cleaning tile surfaces.

It is a further object of the present invention to provide a grout brush which can be positioned at many varied angles for maximum cleaning effectiveness.

It is another object of the present invention to provide a grout brush which consists of a self-contained, sealed, unitary body housing electric power means and appropriate gearing to simultaneously rotate two separate brush cleaning surfaces for full and effective cleaning of both grout and tile surfaces.

These and other objects of the invention are accomplished by the manually operated handheld grout brush of the present invention. The grout brush has an outer housing which sealingly encloses upper and lower contiguous spaces. Electric batteries in the upper space run an electrical motor, which powers gearing to rotate two sets of brushes, a grout brush head with rigid bristles for hard scrubbing and scouring dirty, mildewed, and stained rough grout surfaces, and a tile scrubbing brush head which may include one or two common scrub brushes for cleaning glossy, smooth tile surfaces.

Novel features which are considered as characteristic of the invention are set forth in particular in the appended claims. The invention itself, however, both as to its design, construction and use, together with the additional features and advantages thereof, are best understood upon review of the following detailed description with reference to the accompanying drawings.

DETAILED DESCRIPTION OF THE DRAWINGS

Figure 1:
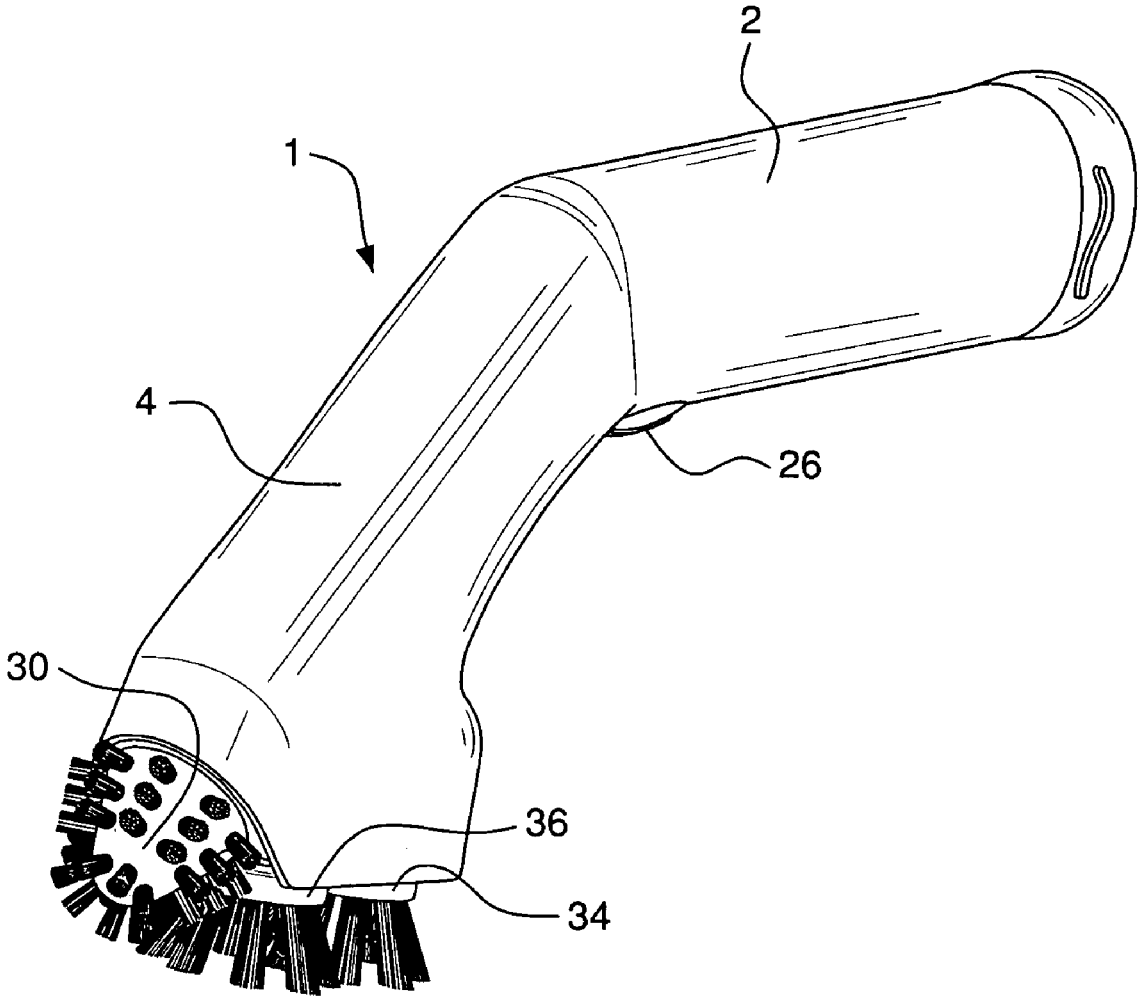
FIG. 1 is an isometric view of the grout brush of the present invention.
Figure 2:
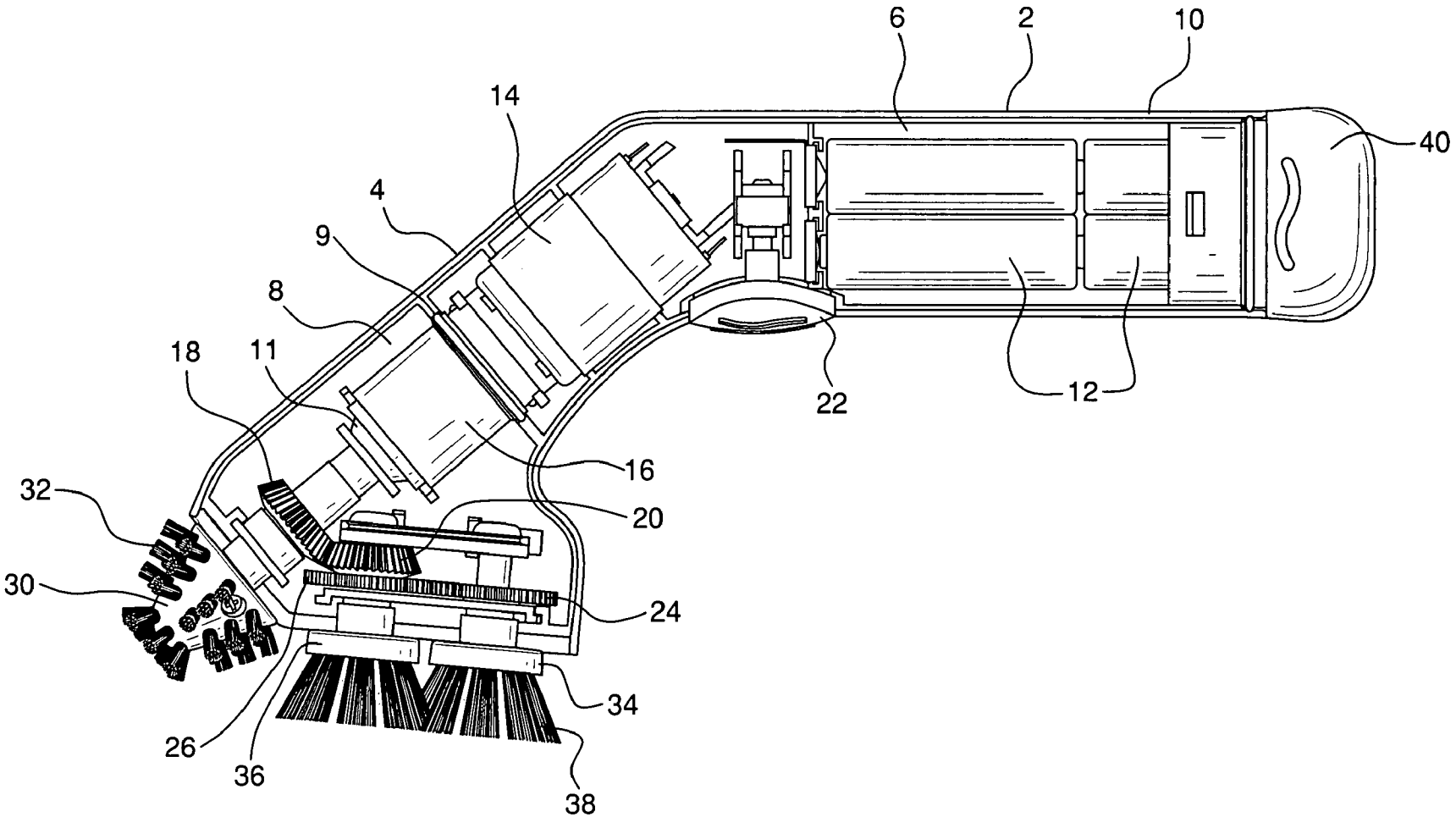
FIG. 2 is a cross-sectional view of the grout brush of the present invention.

Manually operated, handled grout brush implement 1 of the present invention comprises a unitary body with upper handle section 2 and contiguous lower section 4. The unitary body of grout brush 1 is substantially encased by housing 10 which sealingly encloses space 6 in upper section 2 and contiguous space 8 in lower section 4. Space 6 within housing 10 is a watertight compartment, sealed by static o-ring 9. This protects the components located within space 6 from the entry of fluid. Space 8 is not watertight, but rotary lip seal 11 provides waterproof protection to planetary gearing 16, located with the space.

Positioned within space 6 of upper section 2 are batteries 12 which provide the source of electrical power for brush 1. The batteries could be replaceable or rechargeable, or the unit could be powered by a plug-in electrical adapter. Positioned within space 8 of lower section 4 are motor 14, planetary gearing 16 and internal gear sets 18, 20, 24 and 26. Actuating switch 22 is positioned within space 6 of upper section 2 as well. Actuating switch 22 can be a click on/click off, or momentary type switch.

Extending from lower section 4 is rotary grout brush head 30 having stiff, substantially inflexible, rigidly extending bristles 32, for cleaning rough and hardened grout surfaces. Bristles 32 extend outwardly from brush head 30, past the outer surface of housing 10. In other words, tangent lines drawn over the topmost surfaces of bristles 32 would not intercept, but would extend past housing 10.

Also extending from section 4 are dual scrubbing brush heads 34 and 36 with outwardly extending scrub type bristles 38. Bristles 38, while stiff, are substantially less rigid, more flexible and generally far softer than grout cleaning bristles 32. Bristles 38 are thus more conducive for use on tile surfaces. Grout brush head 30 is positioned at an angle in relation to scrubbing brush heads 34 and 36.

Scrubbing brush heads 34 and 36 are connected to internal gear sets 24 and 26 respectively, which in turn interconnect with gearing 20 and 18, connected to planetary gearing 16, keyed to electrical motor 14 for rotary movement of the heads. Similarly, grout brush head 30 is keyed to gearing 18, planetary gearing 16 and motor 14 for rotatable movement.

Upon actuation of switch 22, electrical power from batteries 12 or other power source operates motor 14, which drives planetary gearing 16, which then rotates grout brush head 30 and scrubbing brush heads 34 and 36 through appropriate gearing 18, 20, 24, and 26.

In this manner, hard scrubbing and scouring of grout surfaces can be accomplished by positioning grout brush implement 1 such that the rigid bristles 32 of grout brush head 30 contact the grout surfaces. The unique length of bristles 32 relative to housing 10, as described above, permits grout brush implement 1 to be held in numerous different positions, literally including upside-down, so that bristles 32 can be positioned to contact grout surfaces for maximum cleaning effectiveness without concern that housing 10 will contact these surfaces.

The position of grout brush implement 1 can also be easily changed to allow scrubbing bristles 38 of heads 34 and 36 to contact dirty surfaces to scrub and clean debris away from the grout surfaces and also to the clean flat tile and similar surfaces.

The compact, lightweight, self-contained nature of grout brush implement 1 makes it conducive for use in cleaning both grout and flat surfaces, without rigorous scrubbing or scouring action. The grout brush head 30 is especially adaptable for cleaning lined grout between tile surfaces and scrubbing brush heads 34 and 36 for smooth and finished surfaces. The relative angle between brush head 30 and brush heads 34 and 36 allows the user to hold grout brush implement 1 in many different positions and to readily and comfortably shift between different brush heads, using the same cleaning implement. Batteries 12 can be simply and easily replaced by removing end cap 40 from upper section 2, removing the batteries, and installing fresh ones or recharging the ones being used. As described previously, electrical power could also be provided by a plug-in adapter unit.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A manually operated, handheld brush implement comprising:

a unitary body having an elongated upper handle section to be gripped by a user and an elongated lower section contiguous with the upper handle section, the lower section extending at an oblique angle relative to the upper handle section, said body having outer housing means enclosing an elongated first space within the handle section and elongated second space within the lower section, said second space being contiguous and extending at the oblique angle relative to the first space;

a source of electricity located within the elongated first space of the handle section;

drive means powered by the source of electricity for operating gear means, said drive means and gear means located within the elongated second space;

switch means located within the first space of the upper handle section and adjacent to the second space within the lower section for actuating the drive means;

first rotatable brush unit means comprising rigid bristles, for rotatable hard scouring of engrained soiled, stained and mildewed surfaces;

separate, second rotatable brush unit means, comprising bristles of less rigidity than the bristles of the first rotatable brush unit means, for rotatable cleaning of smooth and finished soiled surfaces adjacent to engrained surfaces, both the first and second rotatable brush unit means extending from the lower section at an angle in relation to each other, whereby upon actuation of the drive means by the switch means, the gear means rotatably operates both the first and second rotatable brush unit means in tandem, configuring the implement for simultaneous rotatable hard scouring of engrained surfaces by the first rotatable brush unit means and for rotatable cleaning of smooth and finished surfaces by the second rotatable brush unit means.

2. The brush implement as in claim 1 wherein the first rotatable brush unit means comprises a grout brush.

3. The brush implement as in claim 1 wherein the second rotatable brush unit means comprises at least one scrub brush.

4. The brush implement as in claim 1 wherein the second rotatable brush unit means comprises two scrub brushes.

5. The brush implement as in claim 1 wherein the gear means comprises planetary gearing simultaneously interconnecting first and second internal gear sets.

6. The brush implement as in claim 5 wherein the first internal gear set rotatably operates the first rotatable brush unit means and the second internal gear set operates the second rotatable brush unit means.

7. The brush implement as in claim 1 wherein the source of electricity comprises at least one battery located within the first space of the outer housing means.

8. The brush implement as in claim 1 wherein bristles of the first brush unit means protrude outwardly and extend past the outer housing means.

* * * * *